US009220332B1

(12) United States Patent
DeVito

(10) Patent No.: US 9,220,332 B1
(45) Date of Patent: Dec. 29, 2015

(54) MODERN GENERATION SEALED COMPACT CASE

(71) Applicant: Ralph DeVito, Oxford, CT (US)

(72) Inventor: Ralph DeVito, Oxford, CT (US)

( * ) Notice: Subject to any disclaimer, the term of this patent is extended or adjusted under 35 U.S.C. 154(b) by 0 days.

(21) Appl. No.: 14/545,318

(22) Filed: Apr. 22, 2015

(51) Int. Cl.

| | |
|---|---|
| ***B65D 43/14*** | (2006.01) |
| ***B65D 51/18*** | (2006.01) |
| ***A45D 33/00*** | (2006.01) |
| ***A45D 33/22*** | (2006.01) |
| ***B65D 25/10*** | (2006.01) |
| ***B65D 43/16*** | (2006.01) |
| ***B65D 43/22*** | (2006.01) |
| ***B65D 25/54*** | (2006.01) |

(52) U.S. Cl.
CPC ..... *A45D 33/006* (2013.01); *A45D 33/22* (2013.01); *B65D 25/108* (2013.01); *B65D 25/54* (2013.01); *B65D 43/16* (2013.01); *B65D 43/22* (2013.01); *A45D 2200/052* (2013.01)

(58) Field of Classification Search
CPC ..... B65D 43/22; B65D 25/54; B65D 43/16; B65D 25/108; A45D 2200/052; A45D 33/006; A45D 33/22
USPC ..... 220/835, 834, 784, 377, 254.1; 132/293, 295; 206/581, 235, 823
See application file for complete search history.

(56) References Cited

U.S. PATENT DOCUMENTS

| | | | | |
|---|---|---|---|---|
| 6,484,895 | B2 * | 11/2002 | Montgomery | B65D 47/0861 215/237 |
| 6,923,335 | B2 * | 8/2005 | Fujita | B65D 50/061 132/293 |
| 2012/0305442 | A1 * | 12/2012 | Apodaca | A45D 33/006 206/581 |
| 2013/0087165 | A1 * | 4/2013 | Lee | A45C 13/008 132/286 |

* cited by examiner

*Primary Examiner* — Fenn Mathew
*Assistant Examiner* — Don M Anderson
(74) *Attorney, Agent, or Firm* — K. Gibner Lehmann

(57) ABSTRACT

A cosmetic compact having a base, and a lid assembly having a window hingedly connected to the base. The lid assembly and window are movable between open and closed positions. A platform member carries the cosmetic product, and can move in the manner of a float between the base and lid assembly. A cam mechanism on the window in the form of depending lugs, cooperates with camming ramps on the platform member. Exteriorly accessible manually engageable grip members connected with the platform member, allow the latter to be rotated with the lid assembly closed. Such rotation effects a tightening of the seal between the window and the platform member, by virtue of the action of the window lugs on the platform member's camming ramps. Improved seal between the window and the platform member is accomplished by virtue of such tightening. In addition, the arrangement is such that the compact can be locked against inadvertent opening, simultaneously with the tightening and sealing action on the platform member.

20 Claims, 18 Drawing Sheets

MODERN GENERATION SEALED COMPACT CASE

NO CROSS REFERENCES TO RELATED APPLICATIONS

Field of the Invention

This invention relates generally to cosmetic containers, and more particularly to containers of a type intended to provide an improved seal when the container is disposed in a closed position, as during storage, shipping or between uses.

BACKGROUND OF THE INVENTION

The following references are believed to relate to the technical field to which the present invention pertains:

U. S. Pat. Nos.: 1,672,417 1,818,409 2,054,004 2,182,040 5,186,318 5,884,636 5,909,738 7,464,820

Considering the patents chronologically, U.S. Pat. No. 1,672,417 discloses a compact having a closure hinged to a circular body, and wherein a locking member for the closure is movably mounted in an angular slot in the body outer wall. The locking member can latch onto a bead or rib formed on the underside of the closure, according to its angular disposition on the body. It is slidable within limits, to oppositely disposed angular positions corresponding to a locked condition of the closure, or an unlocked condition thereof, the latter case permitting the closure to swing open, for use.

U.S. Pat. No. 1,818,409 shows a structural arrangement somewhat similar to that of the previously noted patent. A locking member is slidable on the outer wall of a cosmetic compact body, and has an inwardly extending projection that can travel along an internal rib on the underside of the compact's hinged closure. The operation is the same as in the previous device, wherein opposite angular positions of the locking member on the body correspond to openable or locked conditions, respectively, of the closure.

U.S. Pat. No. 2,054,004 illustrates a vanity case having a cup-like body and a closure hinged thereto. Within the body is a product-carrying tray for cosmetic material. The tray is captive but movable in the body, being spring loaded by metal leaves, toward an upward position. A gasket on the rim of the tray is engaged by the underside of the closure, and the latter in turn presses down on the tray's rim to form a seal therewith.

U.S. Pat. No. 2,182,040 relates to a container with a twist-on closure. Internal cam lugs in the container are provided on a metal strip at the container opening, and corresponding exterior grooves in the closure fit the cam lugs, to enable screwing of the closure to a sealing position.

U.S. Pat. No. 5,186,318 describes several air-tight, hinged containers for cosmetic products. In each case, the seal between the container body and its closure is effected by means of a resilient gasket on the container lip. The gasket has a thin, peripheral compressible curl or set, which can be deformed by the closure when the latter presses on it.

U.S. Pat. No. 5,884,636 involves a cosmetic container having a body, a screw cap, and a hinged inner tray on the body. The latter includes a peripheral lip, which seals against a flat window portion of the screw cap. The seal is indicated by the numeral 38 in FIG. 2 of the patent.

U.S. Pat. No. 7,464,820 relates to a compact case having a body, a hinged closure, and an inner tray which forms a first compartment for cosmetic powder and a second compartment for a powder puff. The periphery of the body features an upwardly facing groove having liquid rubber introduced therein and allowed to cure in situ. Peripheral seals are formed for both compartments when the compact is closed.

U.S. Pat. No. 5,909,738 discloses a cosmetic case having a body, a hinged lid, and a floating product-carrying tray. Disposed between the tray and the side wall of the body is a turnable ring having an operating button which extends outwardly through a peripheral groove in the body. The tray and ring have cam components by which the tray can be manually shifted inside the body, and biased upwardly into firmer engagement with the lid underside. A keying lug on the bottom wall of the body fits into a cooperable vertical slot in the tray, to prevent rotation of the latter when the ring is turned by its button. An especially firm engagement between the tray and the lid is claimed to occur, along with an improved seal of the tray contents.

SUMMARY OF THE INVENTION

While the cited patents show both old and more recent cosmetic container proposals, it is believed that heretofore, no particular item stands out as having met with a large degree of success. This could perhaps be a result of unacceptable operation, promotional difficulties, financial considerations and the like. Accordingly it is considered that there still exists a need for a viable, reliable and workable sealed cosmetic compact in the field, especially considering the needs that some products demand, namely freedom from drying out due to long term exposure to the air, resulting from a poorly sealed container.

It is considered that the present invention fulfills at least some of the following objects:

To provide a novel and improved sealed cosmetic compact which is truly reliable in operation, as far as both short-term and long-term sealing characteristics are concerned.

To provide an improved cosmetic compact as above, which in operation, features a simple lever-type manual movement involving simultaneous closing and sealing functions.

To provide an improved cosmetic compact in accordance with the foregoing, which can be readily manufactured in plastic, using straightforward mold cavities.

To provide an improved cosmetic compact of the type noted, which features long life, and high resistance against breakage or other malfunction.

To provide an improved cosmetic compact as above characterized, which provides a clear, untinted and frost-free viewing window, to enable the exact color of the cosmetic substance contained in the compact to be quickly and easily determined by the user.

To provide an improved cosmetic compact in accordance with the above, wherein different prismatic lateral surface configurations can be incorporated in the compact exterior, to accommodate differing visual tastes and/or impressions as might be required, for different customers.

In a preferred embodiment, the invention provides a cosmetic compact, comprising in combination a base, a lid assembly and a hinge pivotally connecting it to said base, said lid assembly comprising a cover having an expansive central opening, said lid assembly further comprising a window fitted in said expansive central opening and sealingly engaged therewith, said window having a downwardly facing, circular sealing surface, and further having a plurality of depending radially inwardly facing latching lugs circumferentially spaced about the periphery of the window, a substantially cylindrical platform member disposed between said base and said lid assembly, said platform member being captive therein and further being movable within limits in both a vertical and a horizontal direction with respect to said base and lid assembly, and being turnable therein, said platform member further having an upwardly facing circular sealing surface adapted to seal against the sealing surface of the window, said base having an upwardly facing, semi-circular bearing surface against which said platform can rest or alternately be manually turned within limits, said base further having a pair of upwardly facing cut-outs in said bearing surface, said platform member having two oppositely disposed radially extending bridges, extending outward through said cut-outs in the base, respectively, a pair of manually-engageable substantially semi-circular actuator grip members on said bridges, respectively, and disposed at the exterior of said base so as to be accessible to the fingers of the user, and a series of circumferentially disposed cam ramps on the exterior of said platform member, said cam ramps having clearance spaces between them to receive the respective latching lugs of the window, whereby upon turning of the actuator grip members when the lid assembly is closed, the window latching lugs ride along the cam ramps to exert a force on the platform member in a direction tending to tighten engagement between said circular sealing surfaces on the window of the lid assembly and on the platform member, and thus reinforce a seal therebetween.

Other features and advantages will hereinafter appear.

BRIEF DESCRIPTION OF THE DRAWINGS

In the drawings, illustrating preferred embodiments of the invention.

DESCRIPTION OF THE PREFERRED EMBODIMENTS, AND BEST MODES KNOWN FOR CARRYING OUT THE INVENTION AS OF THE PRESENT FILING DATE

By way of introduction, the cosmetic compact to be described features a total of three basic operating conditions, namely an open position wherein the contents of the compact are made available to the user; a closed, unlocked position in which the compact is held solely by means of a latch; and a closed, locked and sealed position, which avoids inadvertent opening, and simultaneously effects an air-tight seal of the compact's contents. In the following description, the terms 'closed and sealed'; and 'closed and locked' will be used interchangeably, and are intended to be equivalent terms throughout.

Considering FIGS. 1-5 and 10-13, there is illustrated a cosmetic compact generally designated by the numeral 10. It is seen that the compact exterior is substantially completely cylindrical. A lid assembly 12 to be described hereinbelow is pivotally connected to a base 14. A pair of actuator grip members 16, 16, is disposed midway between the base 14 and lid assembly 12, which operate to lock or unlock the lid assembly.

Figure 6:
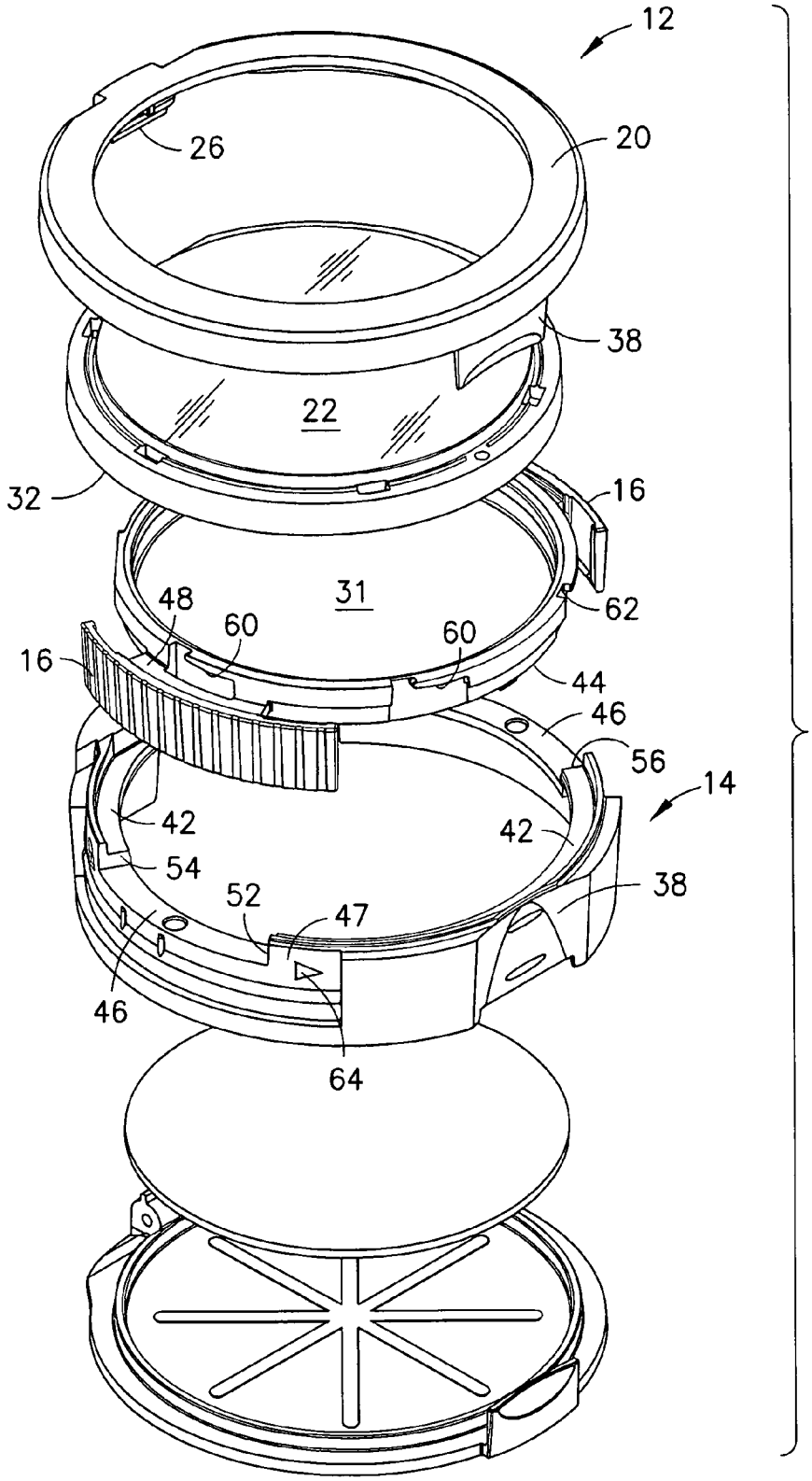
FIG. 6 is an exploded view of the components making up the compact of FIGS. 1-5.
Figure 7:
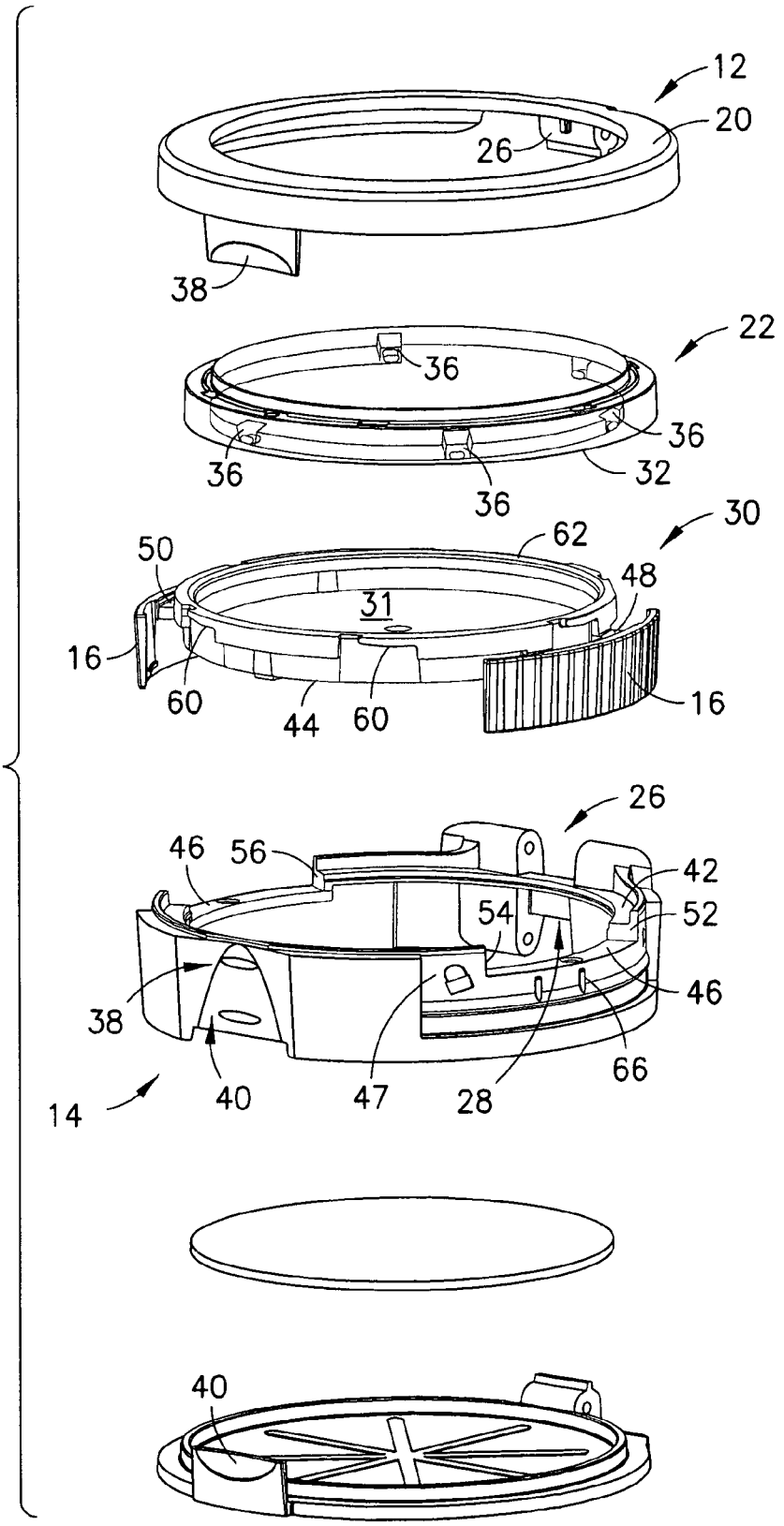
FIG. 7 is an exploded view similar to FIG. 6, showing the components' appearance from a slightly different angle.

Considering the exploded views of the compact in FIGS. 6 and 7, the lid assembly 12 comprises a ring member 20 and a window 22. The window 22 is preferably constituted of clear or semi-transparent plastic, to permit the contents of the compact to be viewed. Returning again to the figures, the lid assembly's ring member 20 is pivotally connected to the base 14 by means of a hinge 26. In the illustrated example, an additional hinge 28 is provided, for another part of the compact involving a separate door at the underside of the base, and a mirror associated therewith, these second components not being further addressed in the present discussion.

Figure 1:
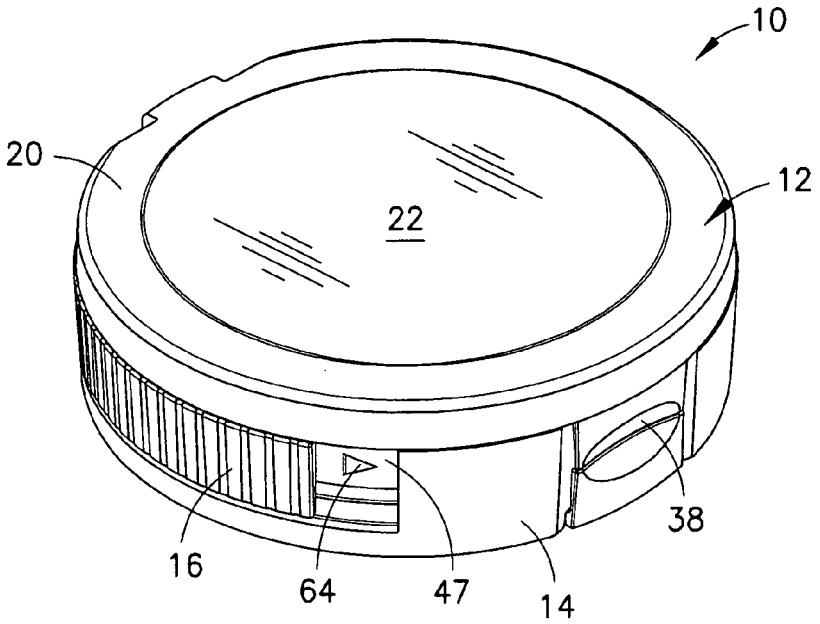
FIG. 1 is an upper front perspective view of the compact of the present invention, shown in a closed, locked position.
Figure 2:
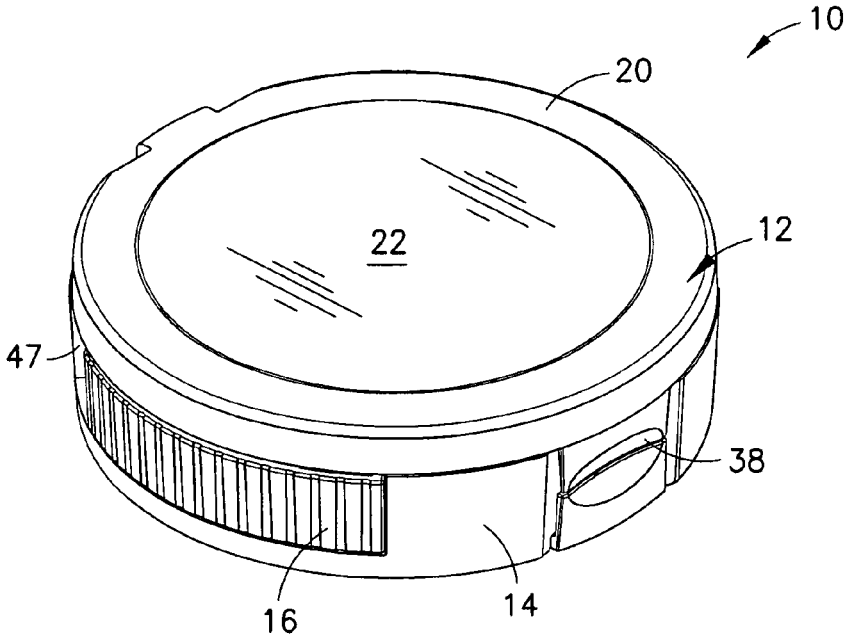
FIG. 2 is a view like FIG. 1, except illustrating the compact in an intermediate state, still closed but in readiness to be opened.
Figure 3:
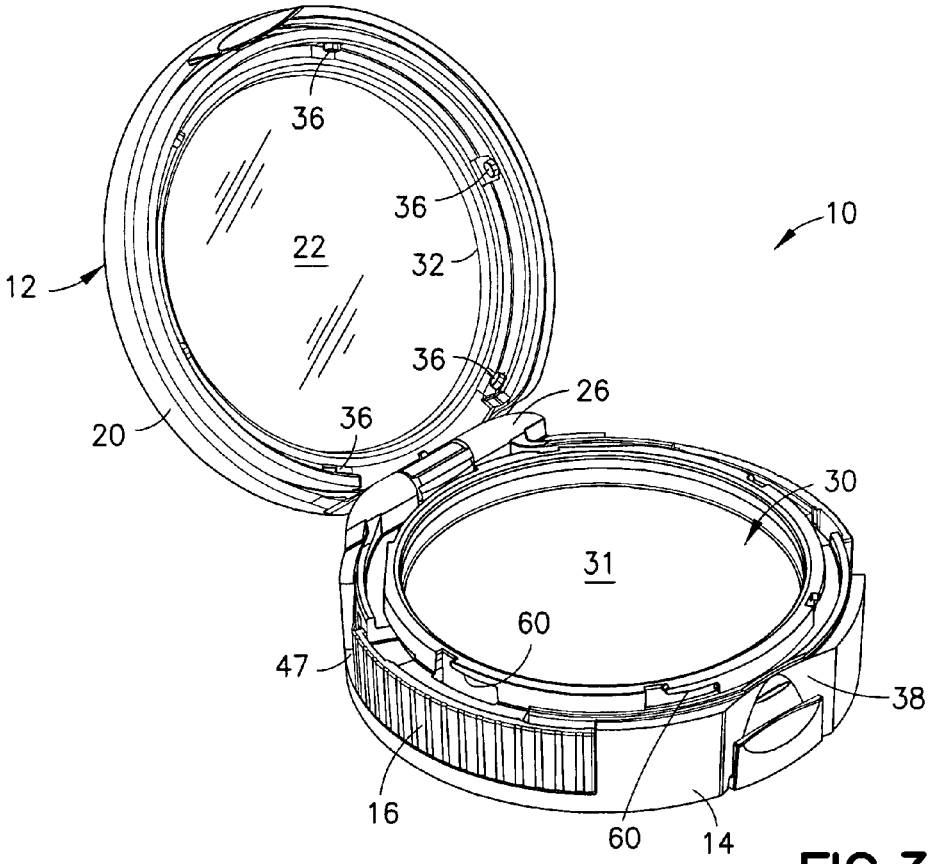
FIG. 3 is an upper front perspective view of the compact of FIGS. 1 and 2, except illustrating the compact in a fully open position.
Figure 4:
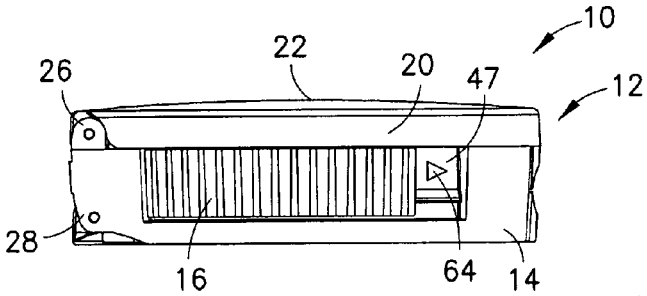
FIG. 4 is a side elevation of the compact of FIGS. 1-3, shown in the locked state of FIG. 1.
Figure 5:
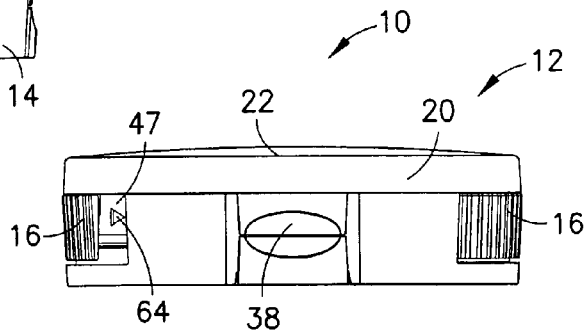
FIG. 5 is a front elevation of the compact of FIGS. 1-4, shown in the locked state of FIGS. 1 and 4.
Figure 10:
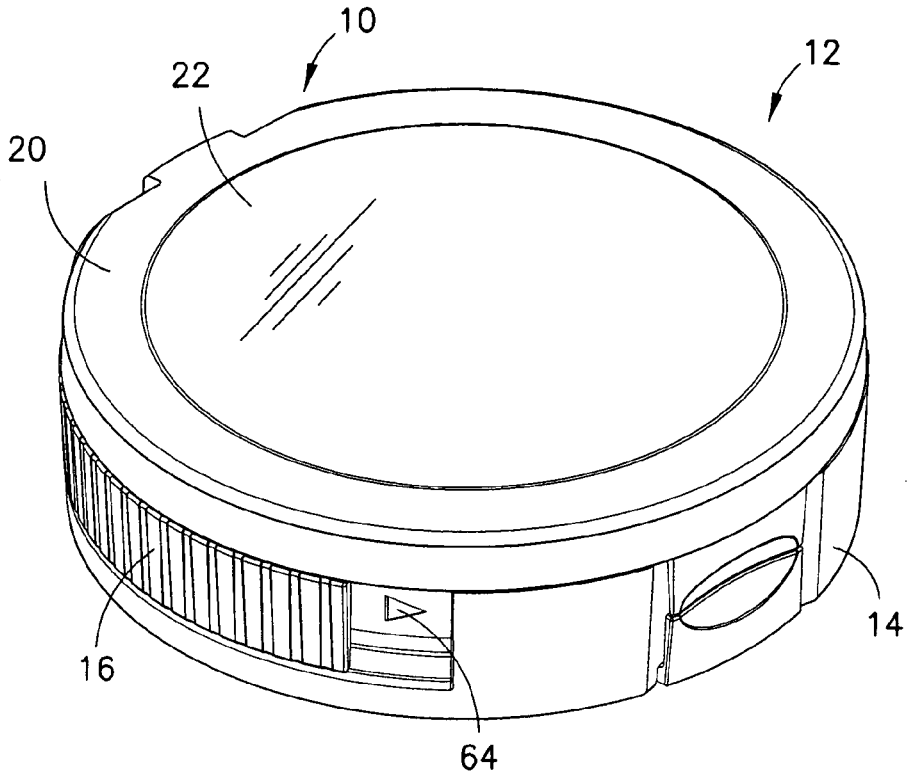
FIG. 10 is an enlarged perspective upper front view of the compact of the previous figures, with the components shown in the locked state, as in FIGS. 1, 4, and 5.
Figure 11:
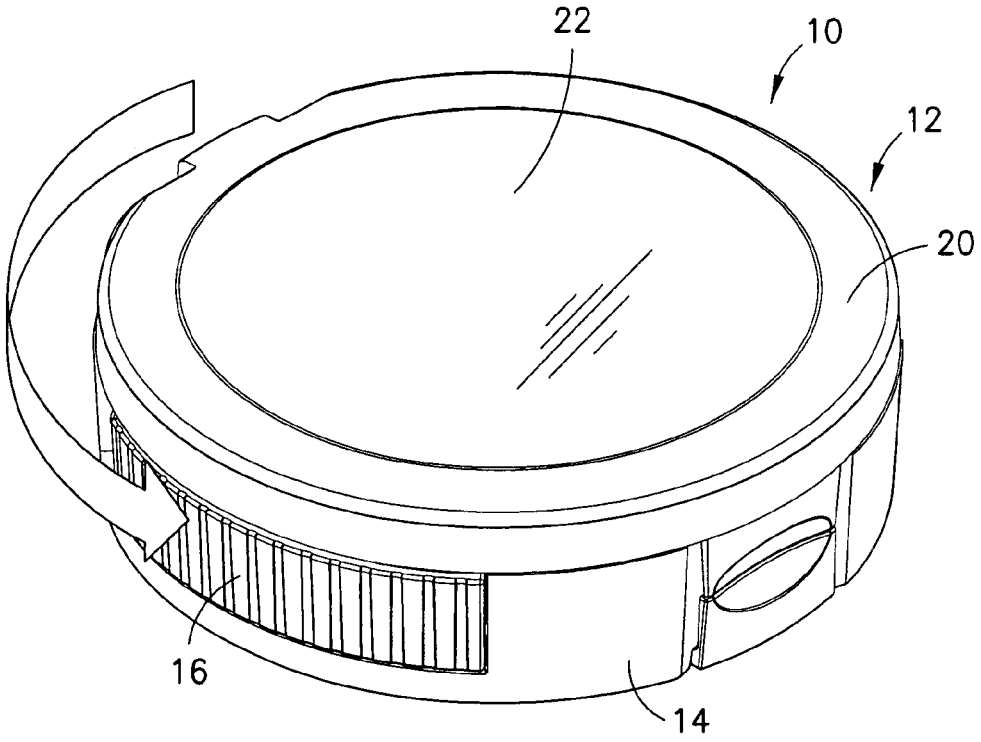
FIG. 11 is a view like FIG. 10, except showing the components disposed in a closed, unlocked position as in FIG. 2.
Figure 12:
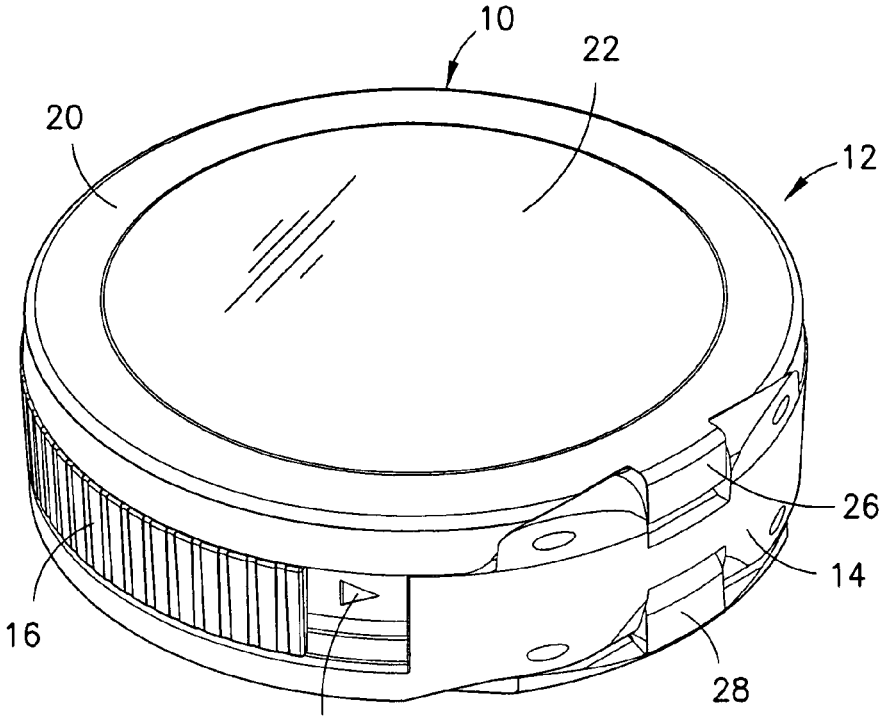
FIG. 12 is a rear perspective view of the compact, with the components shown in the locked state of FIGS. 1, 4, 5 and 10.
Figure 13:
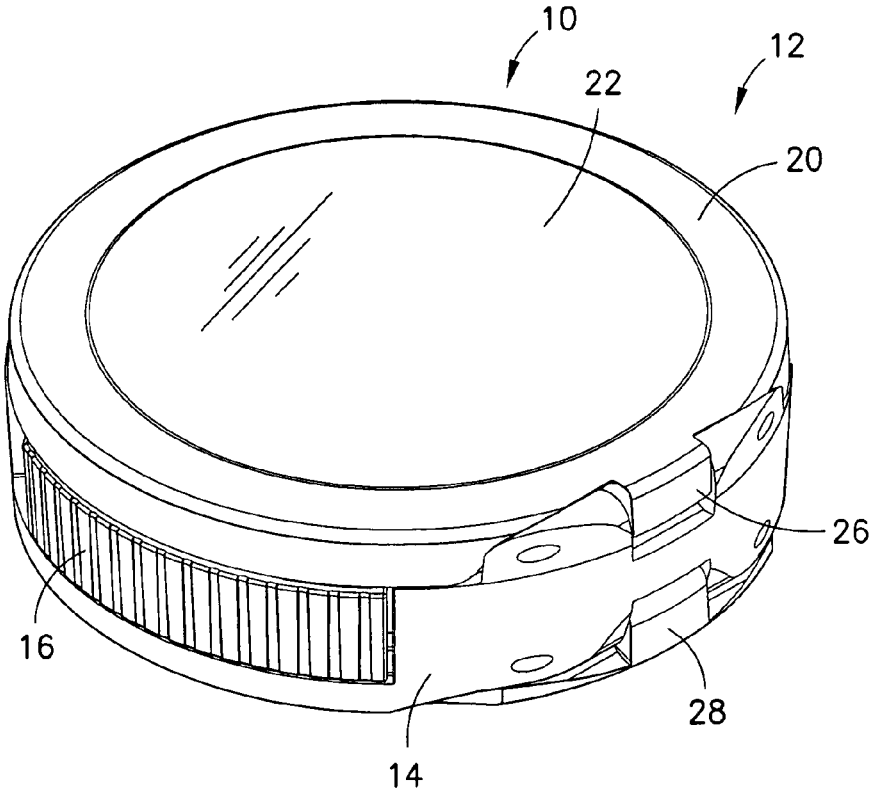
FIG. 13 is a rear perspective view of the compact except showing the components disposed in a closed, unlocked position or state as in FIGS. 2 and 11.

In accordance with the invention there is provided a novel and improved mechanism for locking the compact in its locked, closed position, FIGS. 1, 10 and 12. Simultaneously with said locking, there occurs a minute but finite vertical movement of a platform member 30, FIGS. 3 and 7. The platform member 30 has a body 31, and the cosmetic substance of powder or other material is carried in a upwardly facing recess in the platform member body 31, for access by the user in the usual manner when the compact is disposed in its open position, FIG. 3.

Referring to FIG. 3, and FIGS. 8*a*-8*f*, in accomplishing the seal of the platform member contents, the window 22 is provided with a circular rim 32 on its underside, having a sharp circular edge indicated 23. The window 22 is rigidly affixed in the ring member 20 to the end that both move together as a unit. Disposed on the underside of the window 22 are six circumferentially spaced depending lugs 36, FIGS. 8*b*-8*f*. The lugs are molded integrally with the remainder of the window.

Considering now the base 14, as noted above, it is cylindrical in shape, and in addition to the hinge 26 and latch 38, the interior of the base 14 is provided with opposed semicircular, upwardly facing bearing surfaces 42, FIG. 6, which support a cooperable lower circular slide bearing surface 44, FIGS. 6 and 7, on the platform member 30. In operation, the platform member 30 can be slidably turned on the base bearing surfaces 42 during the locking and sealing phases of the compact.

Referring again to the base 14 in FIGS. 6 and 7, it will be seen that interposed between the bearing surfaces are two recesses or cutouts 46, which provide clearance for components to be described. Also, adjacent to the cutouts 46 are elongate, angular recesses 47, which provide clearance to receive two bridges 48, 50 respectively, on two actuator grip members 16, 16. See FIGS. 6 and 7. The bridges 48, 50 connect the platform member body 31 to the two actuator grip members 16, 16, respectively. The platform member 30, bridges 48, 50, and grip members 16, 16 are all molded integrally with one another, and thus remain rigidly fixed together. Furthermore, it can be seen that the bridges 48, 50 can be slid between two pairs of stop surfaces on the base 14, one pair being numbered 52 and 54 in the figures.

Figure 8:
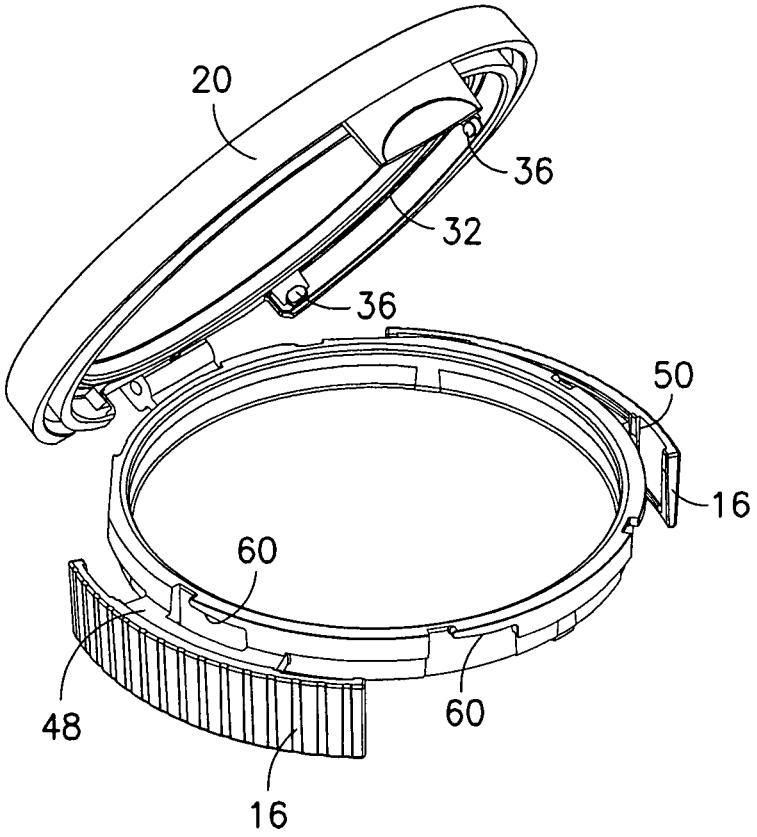
FIG. 8 is an isolated perspective view of two components of the compact, namely the lid assembly and the platform member, in the relative positions they would occupy in an open compact.
Figure 9:
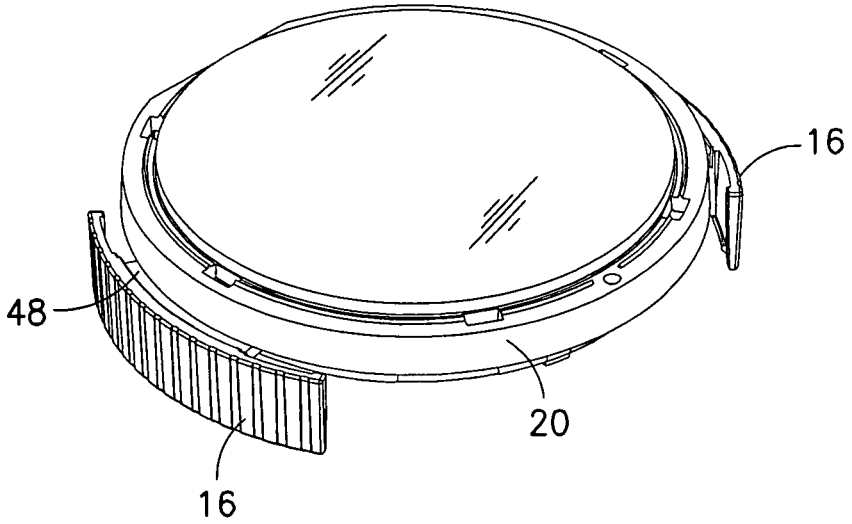
FIG. 9 is an upper perspective view of the components of FIG. 8, in the positions they would occupy when the compact is closed.
Figure 8A:
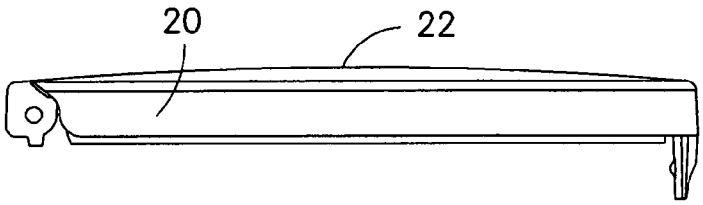
FIG. 8*a* is a side elevation of the lid assembly's ring member and window, as they would appear in a finished state prior to being hinged to the remainder of the compact.
Figure 8B:
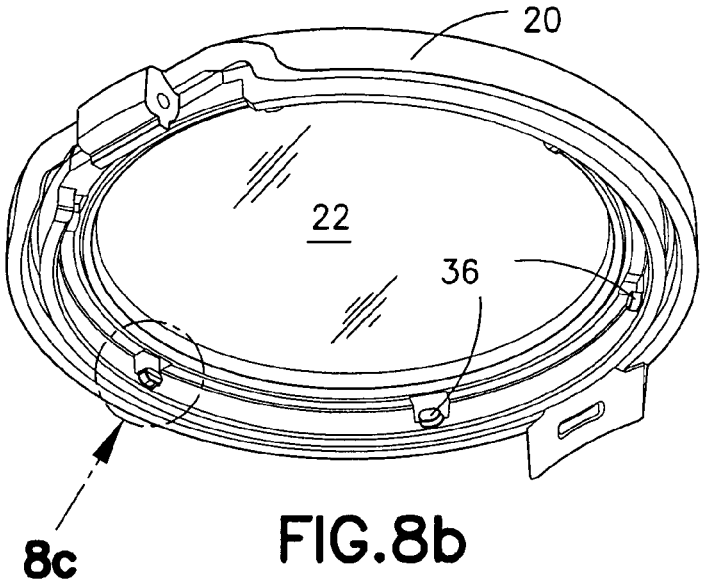
FIG. 8*b* is a bottom perspective view of the window and ring member of FIG. 8*a*.
Figure 8C:
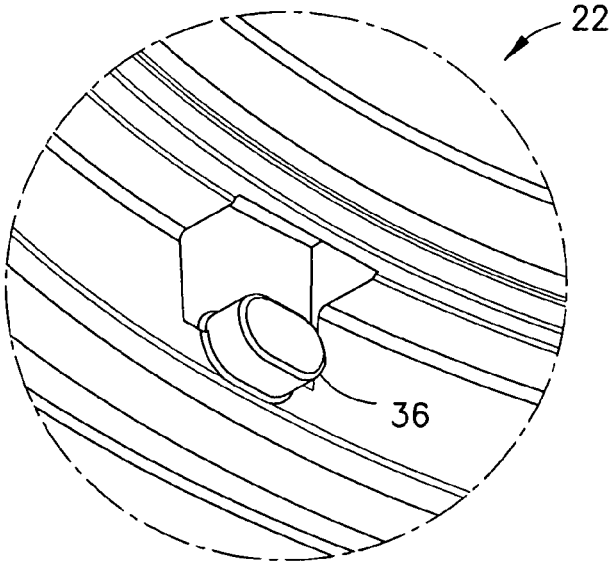
FIG. 8*c* is a detail view of the area so designated in FIG. 8*b*.
Figure 8D:
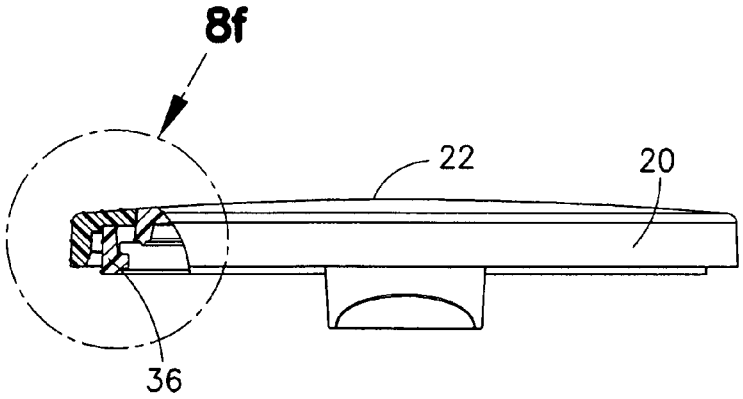
FIG. 8*d* is a front view partly in elevation and partly in fragmentary section, of the window and ring member of FIGS. 8*a* and 8*b*.
Figure 8E:
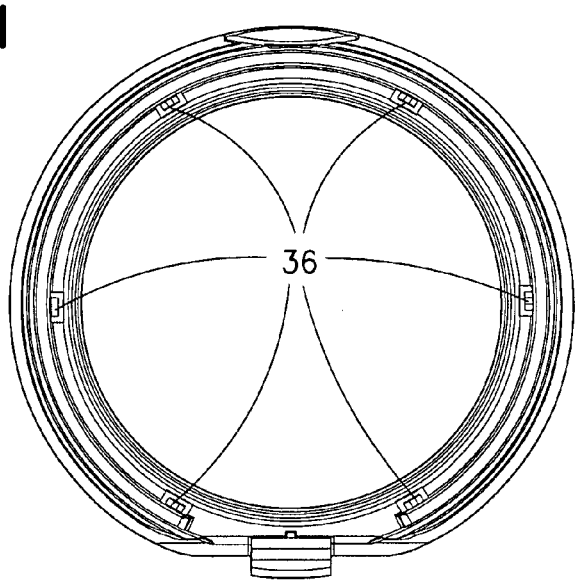
FIG. 8*e* is a bottom plan view of the window and ring member of FIGS. 8*a*, 8*b*, and 8*d*.
Figure 8F:
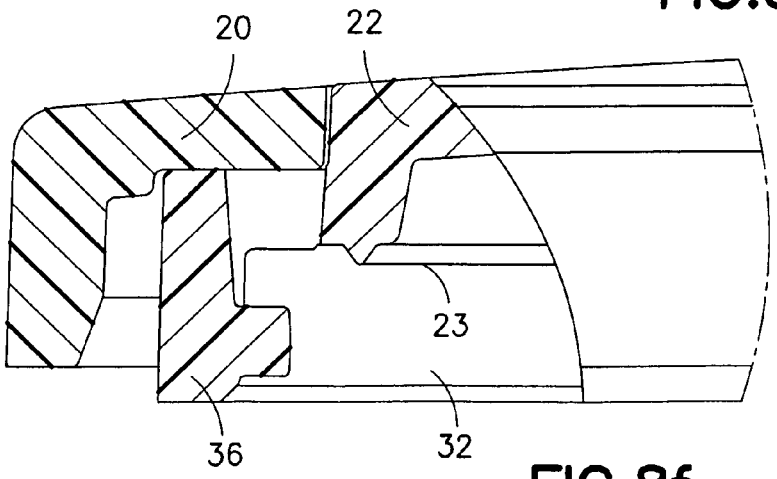
FIG. 8*f* is a detail view of the area so designated in FIG. 8*d*.

Further by the invention, the integrally molded lugs 36 of the window 22, are receivable during closing of the compact, through six corresponding recesses that are disposed between six individual camming ramps 60 on the exterior of the platform member 30. Several of these lugs 36 can be seen in FIGS. 3 and 8. The platform member 30 is thus turnable on the base 14 and with the compact closed, between opposite positions, shown in FIGS. 1 and 2, respectively. The surfaces 52, 54 and 56, 58 limit the movement to a fraction of a turn. With the lid assembly closed, the six window lugs 36 can be brought into engagement with the six camming ramps 60 respectively, on the platform member 30. Thereafter, when the grip members 16, 16 are manually turned, the window lugs 36 ride along the ramps 60 to thereby pull up a platform member gasket 62 against the circular window rim 32.

Figure 15:
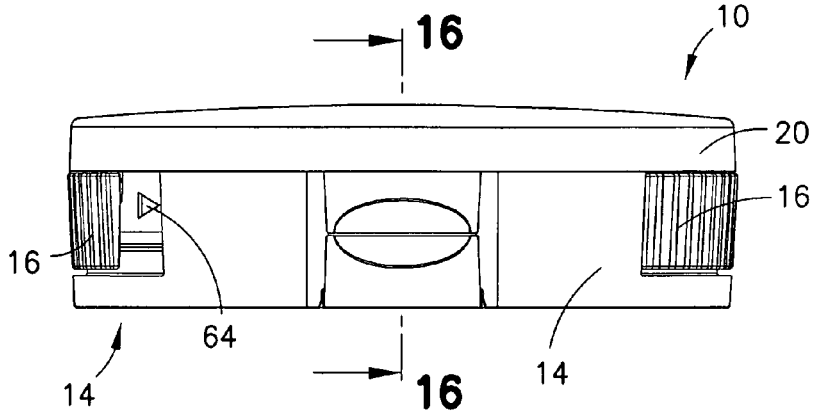
FIG. 15 is a front elevation of the compact shown in the previous figures, in a closed and locked position.
Figure 16:
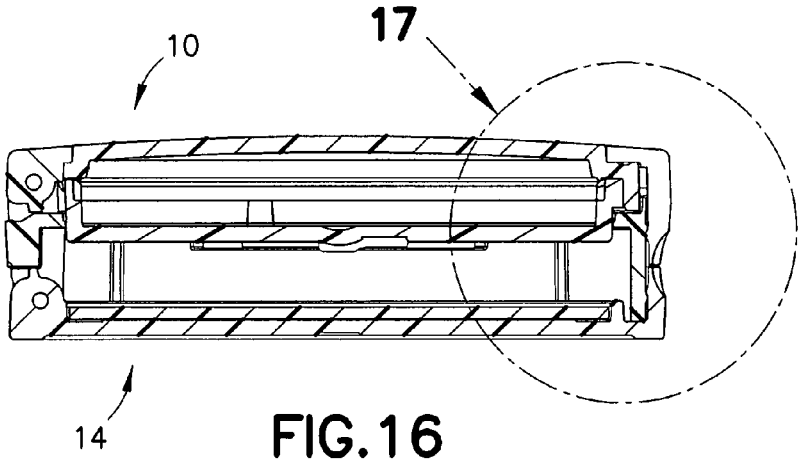
FIG. 16 is a section taken on line 16-16 of FIG. 15.
Figure 17:
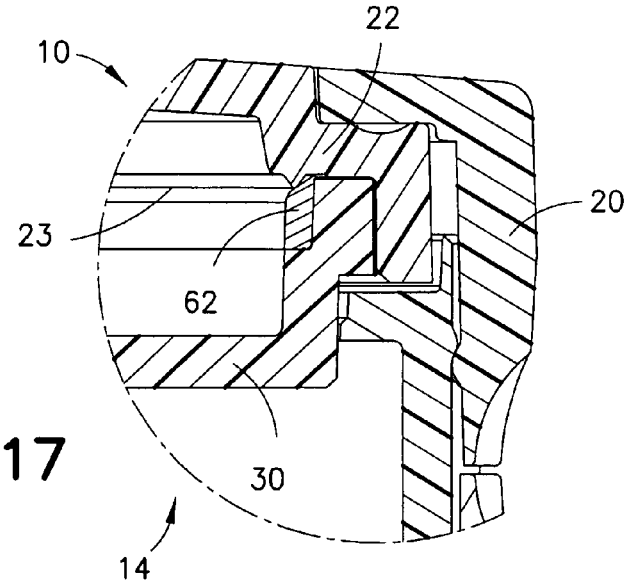
FIG. 17 is an enlarged detail of the portion so designated in FIG. 16.

The details of the seal can be seen in FIGS. 15-20. FIG. 15 is a front elevation of the compact 10, shown in a closed and sealed position and illustrating the base 14, the lid assembly's ring member 20, and two actuator grip members 16, 16, positioned in the closed and sealed position as indicated by the marker arrow 64, FIG. 15. FIG. 16 is a vertical section taken on the line 16-16 of FIG. 15, again illustrating the base and lid assembly of FIG. 15. FIG. 17 shows an enlarged detail of particulars of the seal between the window 22 and the gasket 62 of the platform member 30.

Figure 18:
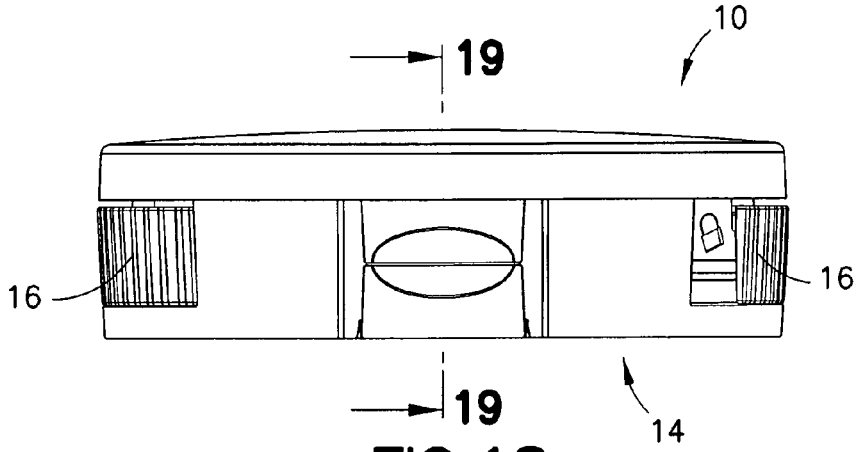
FIG. 18 is a front elevation of the compact shown in the closed and unlocked position.
Figure 19:
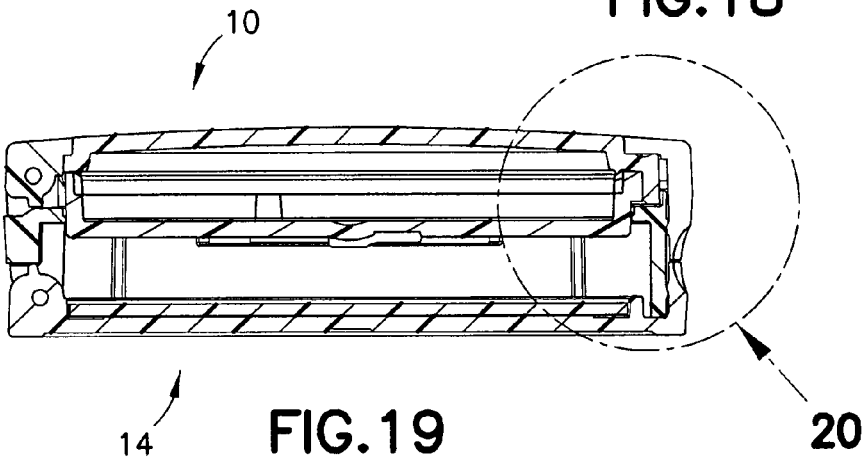
FIG. 19 is a vertical section taken on line 19-19 of FIG. 18.
Figure 20:
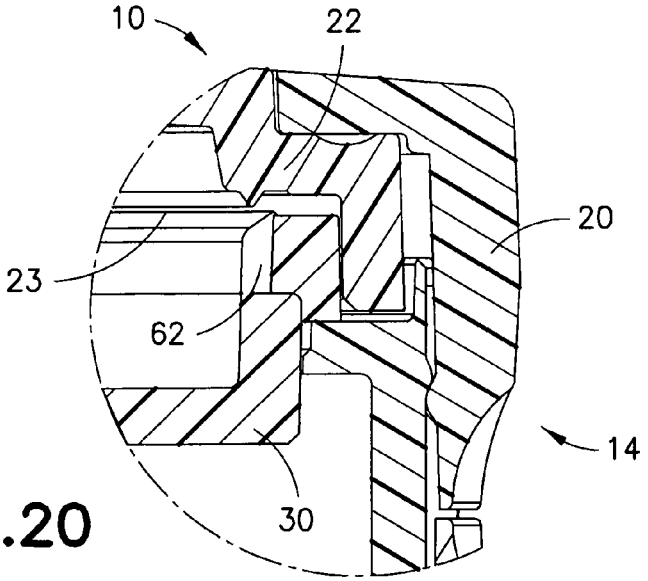
FIG. 20 is an enlarged detail of the portion so designated in FIG. 19.

Upon shifting of the grip members 16, 16 to a position opposite to that of FIGS. 15-17, movement of the platform member 30 occurs. In FIGS. 18-20, the platform member 30 has dropped, by gravity, as occurs when the window lugs 36 have released it by virtue of their having been moved out of engagement with the respective camming ramps 60. In FIGS. 19 and 20, a small space is seen to exist between the edge 23 of the depending skirt of the window 22 and the platform member gasket 62. From this position the compact can be opened as in FIG. 3, to reveal the cosmetic material contained therein.

With the arrangements shown in FIGS. 15-20, the net effect is to render the seal between the platform member gasket 62 and the window 22 virtually completely air-tight, and to thus isolate the cosmetic material from the outside air. The platform member gasket 62 is preferably deposited onto the platform member 30 at the time the latter is molded.

In summary, then, the compact can be stored in the closed, locked position of FIG. 10. The grip members 16, 16 each conceal their respective underlying marks or marker arrows 64 that appear as in FIGS. 10 and 12. When uncovered by actuation of the grip members 16, 16, the marker arrows indicate to the user the direction in which one can shift the grip members 16, 16 in order to reestablish the locking position of the compact. It will be understood that when the grip members 16, 16 are manually shifted by the user, the entire platform member 30 is rotated inside the closed compact, to effect the sliding up of the six window lugs 36 on their respective the camming ramps 60 on the platform member 30.

Figure 14:
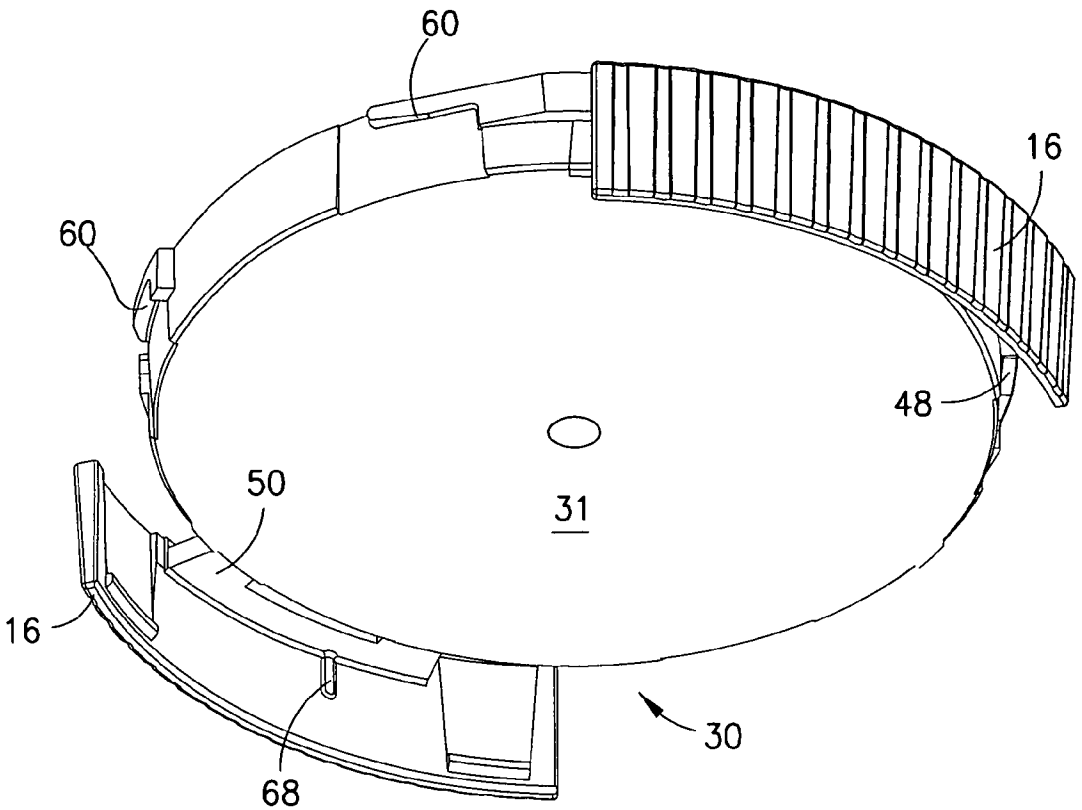
FIG. 14 is a lower perspective view of the platform member, particularly pointing out the location of a detent rib thereon that provides resistance against inadvertent undesired shifting of the member.

Finally, in order to avoid interference between the camming ramps 60 and the window lugs 36, the base and at least one of the grip members 16 have cooperable detent ribs 66 and 68, respectively, FIGS. 7 and 14, which resist inadvertent movement of the platform member out of an intermediary position wherein the spaces between the camming ramps 60 might not align with the window lugs 36. Under such an undesirable condition, the window assembly could jam against the platform member, and render the compact incapable of fully closing. The provision of the detent ribs 66, 68 prevents such interference, by retaining the platform member and grip members in a position essentially the same as that occupied during unlocking and unsealing of the platform member. Preferably both of the grip members 16, 16 are provided with a detent rib such as 68, and both outer surface locations of the base provided with detent ribs 66.

Additional features of the disclosed construction include the provision of the grip members 16 having an elongate and arcuately curved shape, to conform to the contour of the recesses 47. With such an arrangement, the grip members' exterior surfaces constitute continuations of the cylindrical surface of the base exterior, thereby eliminating unsightly protruding lugs or catches of any kind. The locations of the grip members on the compact are such that they are opposite one another, and can be considered to span both the hinge and the latch of the compact, circumferentially. The exterior surfaces of the grip members are ribbed, as shown, but other forms of non-smooth surface irregularity could be substituted, the important consideration being that their engagement by the fingers of the user be facilitated, as during opening or closing of the compact.

Another embodiment of the invention is illustrated in FIGS. 21-24. Reference numerals with the suffix "a" have been added to those parts which correspond to the similarly labelled components of the first embodiment. Unlike the first arrangements of the compact, the present version has incorporated square components for the base and lid assemblies, but with most of the internal parts remaining circular or cylindrical, in both structure and function.

Figure 21:
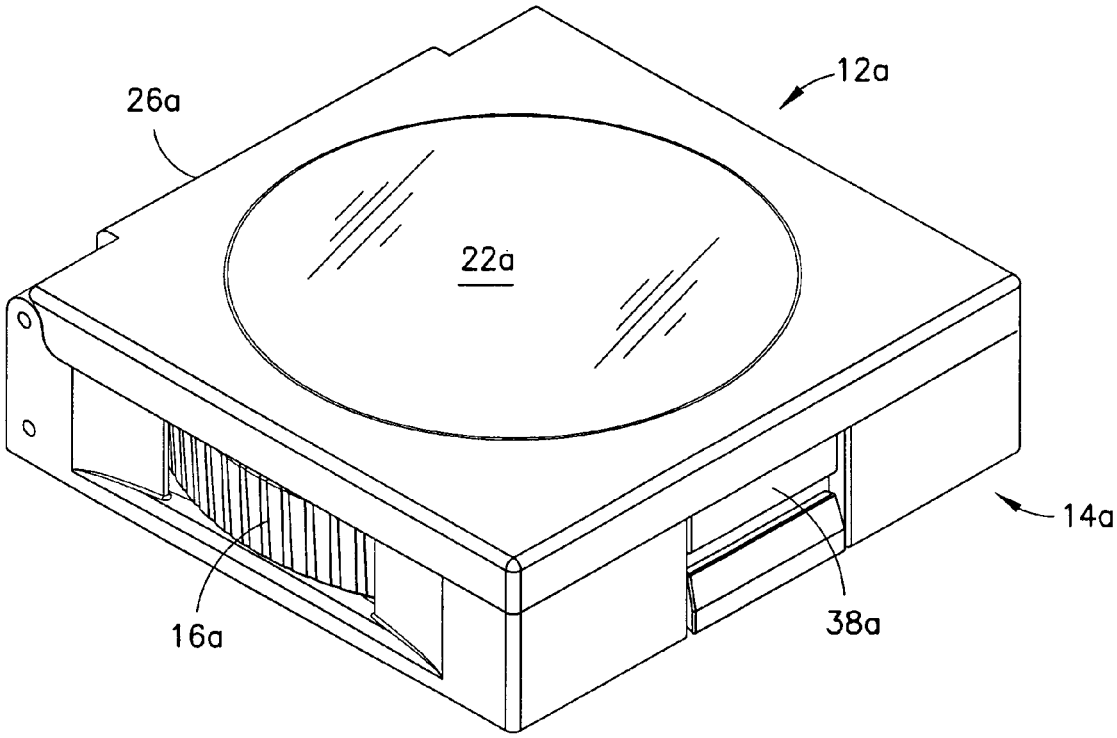
FIG. 21 is an upper front perspective view of a modified cosmetic compact, constituting another embodiment of the invention.
Figure 22:
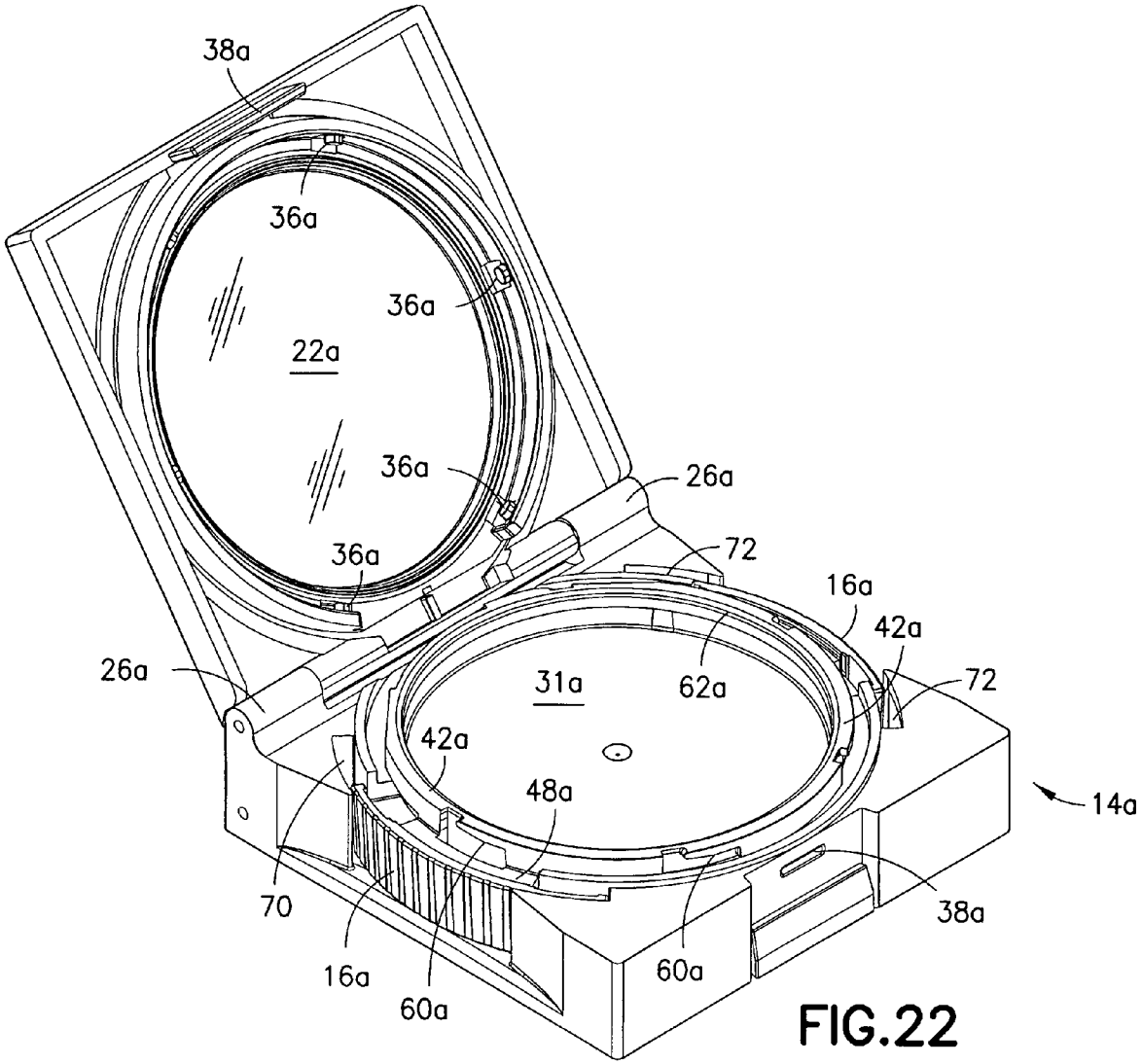
FIG. 22 is a view like FIG. 21, except illustrating the compact of that figure in a fully open position.

In this second embodiment, FIG. 21 illustrates the appearance of the compact when the latter is in either a closed and unsealed position or a closed and sealed position. FIG. 22 shows the compact fully open, with access to the contents of the compact contained in the body 31*a*.

Figure 23:
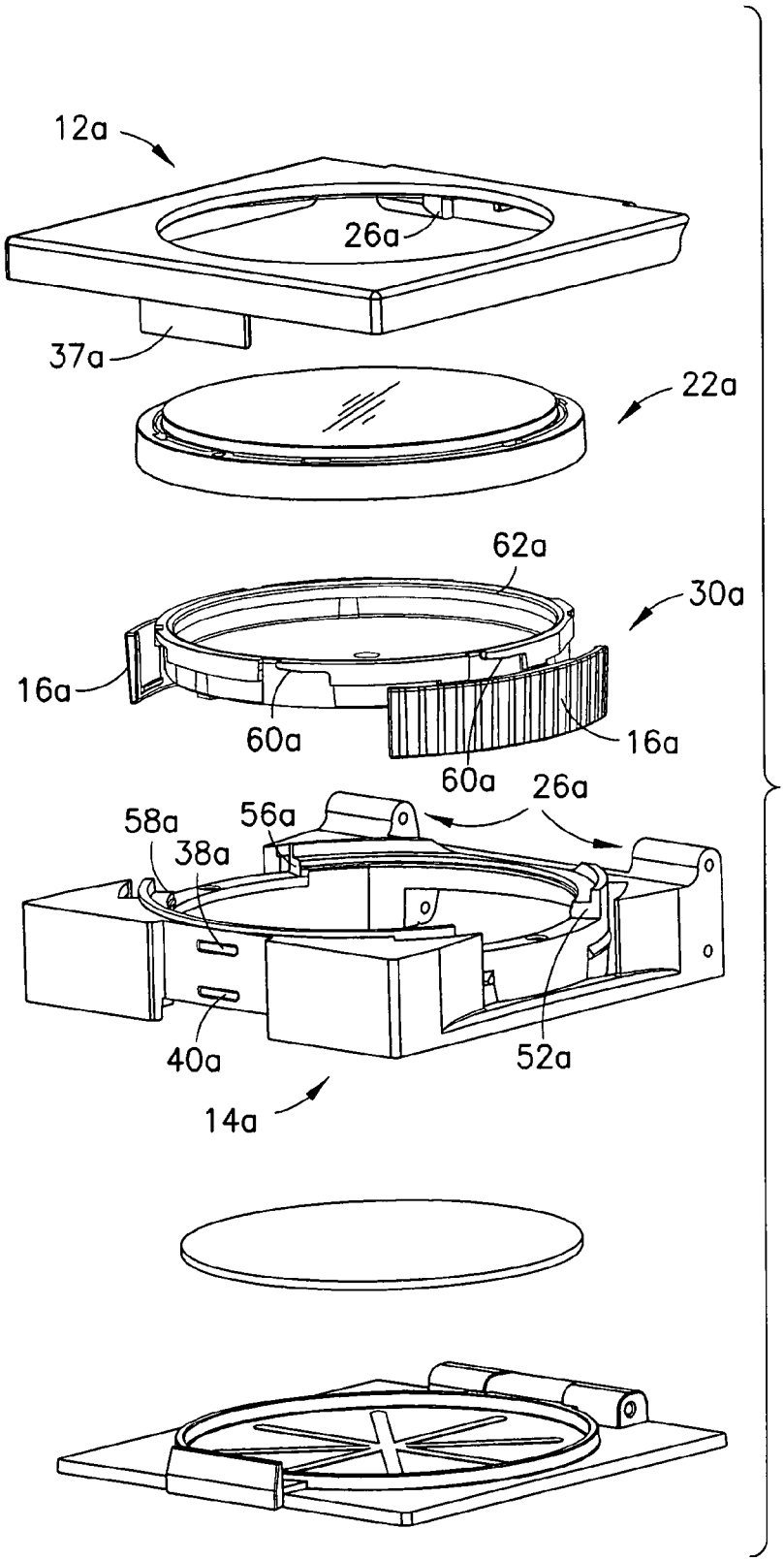
FIG. 23 is an exploded view of the components making up the compact of FIGS. 21 and 22.
Figure 24:
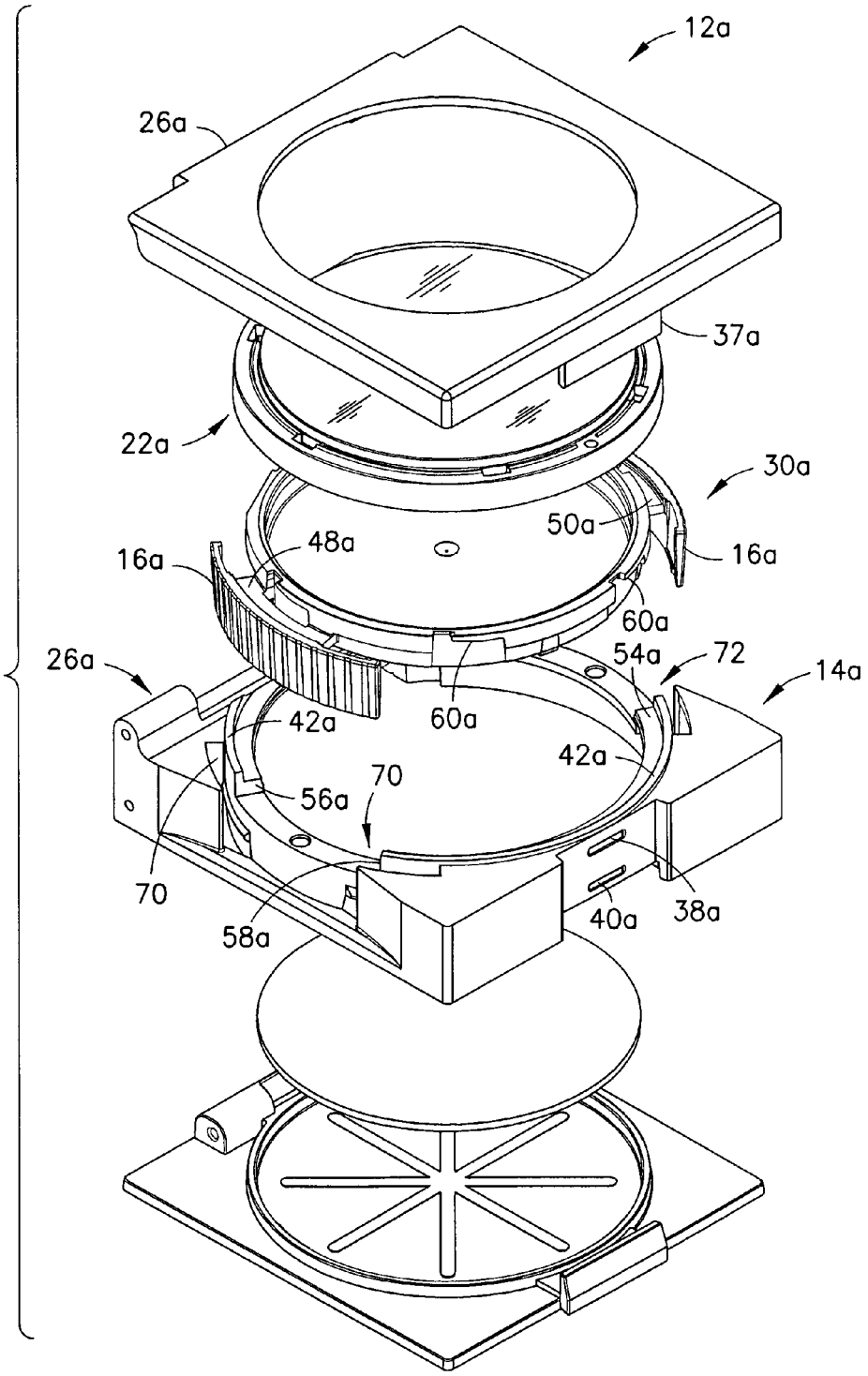
FIG. 24 is an exploded view similar to FIG. 23, showing the components' appearance from a slightly different viewing angle.
Figure 26:
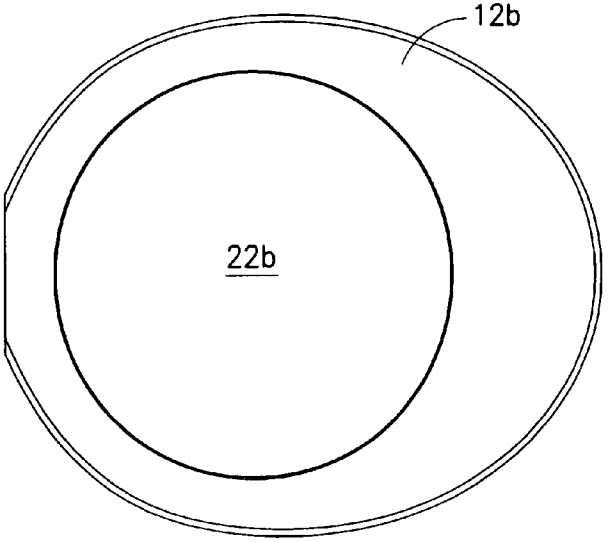
FIG. 26 is a top plan view of the cosmetic compact of FIG. 25.
Figure 28:
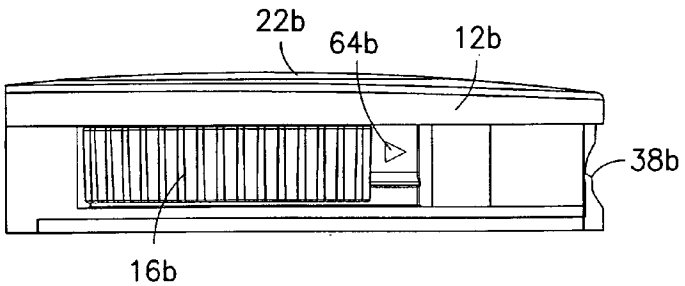
FIG. 28 is a left side elevation of the cosmetic compact of FIGS. 25-27.

Both FIG. 23 and FIG. 24 are exploded perspective views of the internal structures of the rectangular compact. Specifically, the compact includes a lid assembly 12*a*, compact base 14*a* window 22*a* and window frame member. Hinge parts 26*a* pivotally connect the window frame member to the base 14*a*. The cosmetic material to be stored is carried in a platform member 30*a*. The base is formed as four box-like corners. Two of the four corners contain annular slots labelled 70 and 72 respectively, FIG. 22. These slots have a curvature which matches the curvature of the grip members 16*a*, 16*a*, and the latter thus slide angularly in the respective slots, to provide a neat and finished appearance, and to conceal all surfaces of the grip members 16*a*, 16*a*, except the exterior surfaces thereof, which are textured to facilitate their engagement by the finger and thumb of the user.

Attached integrally to the window 22*a* is a plurality of depending lugs 36*a* which lie radially outside a circular window rim. Actuator grip members 16*a*, 16*a* are integrally formed with the platform member and joined thereto by means of bridges 48*a*, 50*a*, respectively. Stop surfaces 52*a*, 54*a*, 56*a*, and 58*a* function to limit the travel of the grip members 16*a*, 16, respectively, as in the first embodiment.

The platform member sealing gasket 62*a* is shown in FIG. 22. However, marker arrows similar to those indicated 46 in the previous embodiment, are not shown in the disclosed arrangement. Nor have the parts corresponding to reference numerals 66 and 68 of the first embodiment been included in this construction.

Still another embodiment of the invention is illustrated in FIGS. 25-28, showing a compact having a distinctive oval outer surface configuration. Reference numerals with the suffix "a" have been added to those parts which correspond to the similarly labelled components of the first embodiment. It is to be noted that most of the internal parts of this oval compact are circular or cylindrical, in both structure and function.

Figure 25:
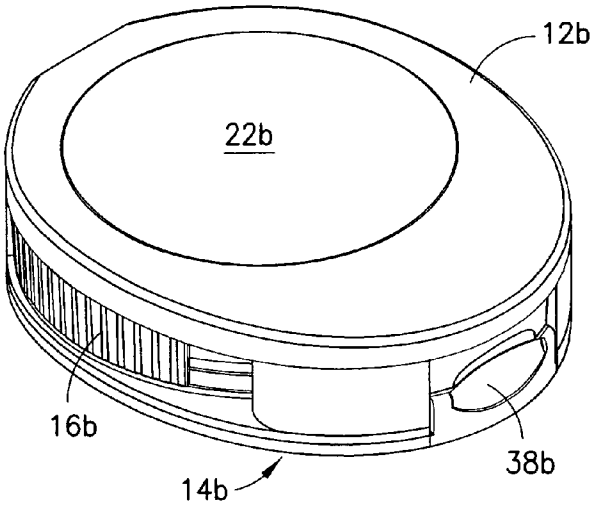
FIG. 25 is an upper front perspective view of a further modified cosmetic compact, constituting yet another embodiment of the invention.

In this embodiment, FIG. 25 illustrates the appearance of the compact when the latter is in an unsealed condition. The base is labelled with the reference numeral 14*b*, and the lid assembly is designated 12*b*. The latch 38*a* is of similar configuration to that of the previous constructions.

Figure 27:
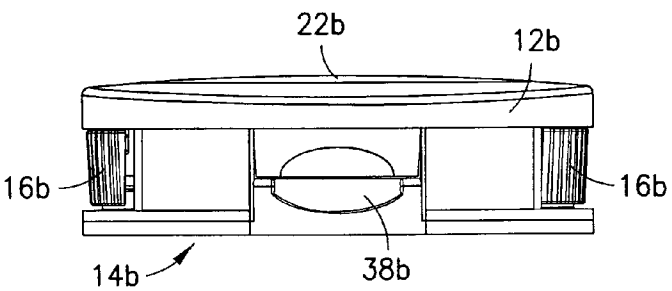
FIG. 27 is a front elevation of the cosmetic compact of FIGS. 25 and 26.

Returning to the figures, the base is seen to have the outer surface configuration of an oval geometric shape, that is, the geometric configuration of the lateral or side surfaces of an oval prism. In this connection, the lid assembly is seen to overlie the base so as to meet it along the full circumference, that is, the lid assembly is substantially congruent with the base. Finger-engageable bridges 16*b* are also provided, as in the first embodiment. The bridges 16*b* are opposite one another, as seen in FIG. 27, and a marker 64*b* is provided on a recess which accommodates the bridges. Only one marker is shown in the figures, the other being on the reverse side to that illustrated in FIG. 28.

In general, the inner structural details of the embodiment of FIGS. 25-28 are substantially the same as those of the first embodiment, as regards the platform member and the lid assembly which carries the window.

Figure 30:
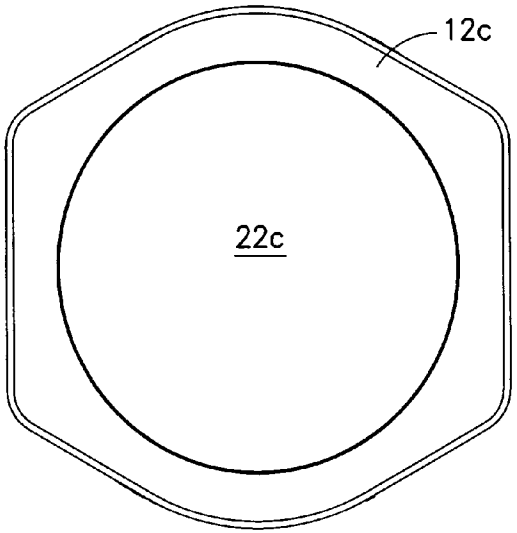
FIG. 30 is a top plan view of the cosmetic compact of FIG. 29.
Figure 29:
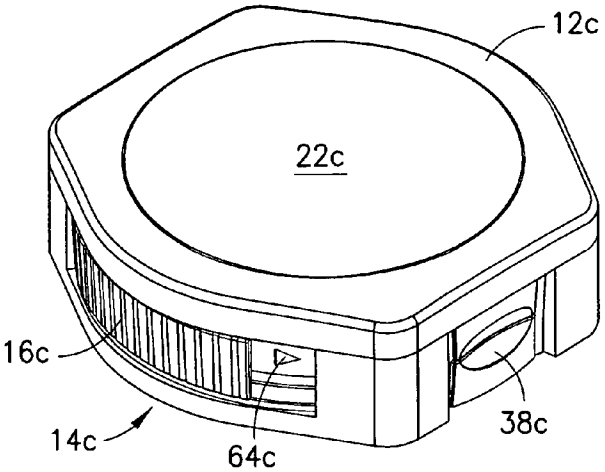
FIG. 29 is an upper front perspective view of yet another modified cosmetic compact, constituting still another embodiment of the invention.
Figure 32:
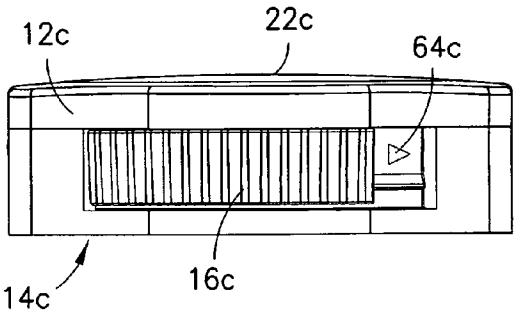
FIG. 32 is a left side elevation of the cosmetic compact of FIGS. 29-31.
Figure 31:
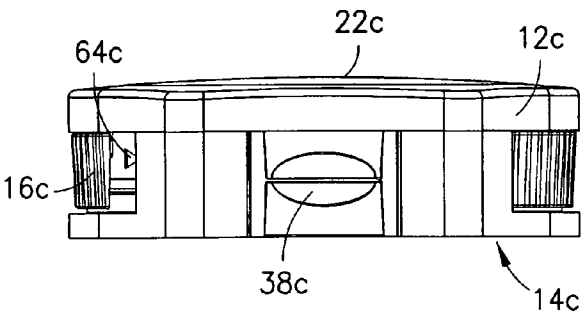
FIG. 31 is a front elevation of the cosmetic compact of FIGS. 29 and 30.

Yet another embodiment of the invention is shown in FIGS. 29-32, wherein the compact base and lid assembly overlie one another as previously, and where the base and lid assembly have the configuration of a modified rectangular configuration with two opposed lateral surfaces bulging outwardly with respect to one another. This feature is best displayed in FIG. 30. The remaining two opposite sides of the base and lid assembly are substantially parallel, again as seen in FIG. 30.

Reference numeral 38*b* is provided on the latch, whereas the finger engageable bridges are assigned 16*c*. Marks 64*c* in the path of the bridges indicate to the user, the direction in which to slide the bridges, in order to unlock the compact.

The illustration of alternate lateral surface configurations is given in a general sense, and not to be construed as limiting. As can be readily understood, further modifications to the general overall external appearance can be envisioned, with the essential quality of providing a substantially completely air-tight connection between the platform member and the window of the lid assembly. For example, the lateral external sides of the compacts can comprise geometric prism configurations of triangular, pentagonal, or hexagonal character, and also slight modifications of the precise shape is hereby proposed, within the scope of the present disclosure.

An additional feature of the present invention is the provision of a window of exceptional clarity. Many prior airtight compacts currently utilize PP, which tends to be cloudy and not crystal clear, or alternately may contain coloring which conceals the true hue of the cosmetic material being dispensed. Colored, stick-on labels are often used with such compacts, to indicate the nature of the shade of the material being dispensed.

By the present invention, the windows are constituted of hard, clear crystalline material, having excellent clarity, to facilitate viewing of the exact hue of the cosmetic material contained in the compact. At the same time, such a window can also provide chemical resistance from volatile gases often contained in cosmetic substances. Use of PCTA (co-polyester), PET (polyester) and/or CN (cellulose nitrate) are examples of plastics which can be used with the invention.

From the above it can be seen that I have provided novel and improved cosmetic compacts which are straightforward in their construction, and which provide a most effective seal of cosmetic material which is placed and stored therein, especially over a lengthy period of time.

Significantly reduced possibility of evaporation of volatile contents in the stored matter is realized. Yet ease of use is retained through the provision of readily accessible, exterior finger grip members on the compacts' exterior surfaces.

The compacts are thus seen to represent a distinct advance and improvement in the cosmetic field.

Each and every one of the appended claims represents an aspect of the invention which is separate and distinct from all others, and accordingly it is intended that each claim be treated as such when examined in the light of the prior art devices in any determination of novelty or validity.

Variations and modifications are possible without departing from the spirit of the invention.

LISTING OF REFERENCE NUMERALS

10 Compact
12 Lid assembly
14 Base
16 Actuator grip members
20 Lid assembly's ring member
22 Window
23 Sharp edge on window rim
26 Hinge
28 Hinge
30 Platform member or intermediary member
31 Platform member body
32 Circular window rim
36 (6) Inwardly facing window latching lugs
38 Latch
40 Latch
42 Bearing surface, base
44 Bearing surface platform member
46 Cutout
47 Recess in outer surface of base
48 Bridge
50 Bridge
52 Stop surface
54 Stop surface
56 Stop surface
58 Stop surface
60 Camming ramp
62 Platform member sealing gasket
64 Marker arrow indicators for grip members
66 Base detent rib
68 Platform member detent rib
70 Recess
72 Recess The embodiments of the invention in which an exclusive property or privilege is claimed are defined as follows:

1. A cosmetic compact, comprising in combination:
a) a cylindrical base,
b) a lid assembly and a hinge pivotally connecting it to said base, said lid assembly comprising a substantially cylindrically shaped cover having an expansive central opening,
c) said lid assembly further comprising a circular window fitted to said expansive central opening and sealingly engaged therewith,
d) said window having a downwardly facing, circular sealing surface, and further having a plurality of depending radially inwardly facing latching lugs circumferentially spaced about the periphery of the window,
e) a substantially cylindrical platform member disposed between said base and said lid assembly, said platform member being captive therein and further being movable within limits in both a vertical and a horizontal direction with respect to said base and lid assembly, and being turnable therein,
f) said platform member further having an upwardly facing circular sealing surface adapted to seal against the sealing surface of the window,
g) said base having an upwardly facing, semi-circular bearing surface against which said platform member can rest or alternately be manually turned within limits,
h) said base further having a pair of upwardly facing cutouts in said bearing surface,
i) said platform member having two oppositely disposed radially extending bridges, extending outward through said cut-outs in the base, respectively
j) a pair of manually-engageable substantially semi-circular actuator grip members on said bridges, respectively, and disposed at the exterior of said base so as to be accessible to the fingers of the user, and
k) a series of circumferentially disposed cam ramps on the exterior of said platform member, said cam ramps having clearance spaces between them to receive the respective latching lugs of the window, whereby upon turning of the actuator grip members when the lid assembly is closed, the window latching lugs ride along the cam ramps to exert a force on the platform member in a direction tending to tighten engagement between said circular sealing surfaces on the window of the lid assembly and on the platform member, and thus reinforce the seal therebetween.

2. The invention as set forth in claim 1, wherein:
a) said base comprises a body, and said body has two exterior arcuately extending recesses,
b) said grip members are of elongate, arcuate configuration, and are curved so as to nest into said recesses, respectively, and wherein the exterior surfaces of said grip members have a curvature substantially matching the curvature of said base.

3. The invention as set forth in claim 2, wherein:
a) said recesses each contain a mark indicating one of two opposite directions in which the respective grip member can be manually moved in its recess.

4. The invention as set forth in claim 1, wherein:
a) the grip members are disposed 180 degrees apart from one another.

5. The invention as set forth in claim 1, wherein:
a) the grip members and their respective bridges are all molded integral with one another and with substantially all of the remainder of the platform member.

6. The invention as set forth in claim 1, wherein:
a) the window's depending lugs are molded integrally with the remainder of the window.

7. The invention as set forth in claim 1, wherein:
a) said grip members circumferentially span the hinge that connects the lid assembly to the base.

8. The invention as set forth in claim 1, wherein:
a) said base and lid assembly have a clasp disposed opposite the hinge, and wherein:
b) the grip members circumferentially span the location of the clasp.

9. The invention as set forth in claim 1, wherein:
a) said grip members have a non-smooth exterior gripping surface, and constitute substantially uniform continuations of adjacent parts of the base.

10. The invention as set forth in claim 1, wherein:
a) said grip members are held in spaced relation with respect to each other and to the remainder of the platform member by said bridges respectively.

11. The invention as set forth in claim 1, and further including:
a) cooperable detent structures on the exterior of the base member and on the inner surface of one grip member, for yieldably retaining the latter in an intermediary position when the lid assembly is open, to avoid interference between the window lugs and the cam ramps when the lid assembly is being moved toward its fully closed position.

12. A cosmetic compact, comprising in combination:

a) a cylindrical base, b) a lid assembly comprising a window, and a hinge pivotally connecting it to said base, to enable the lid assembly to be moved between open and closed positions, c) said window having a downwardly facing, circular sealing surface, d) a substantially cylindrical platform member disposed between said base and said lid assembly, said platform member being captive therein and further being movable within limits in both a vertical and a rotary direction with respect to said base and lid assembly, e) said platform member further having an upwardly facing circular sealing surface adapted to seal against the sealing surface of the window, f) said base having an upwardly facing, semi-circular bearing surface against which said platform member can rest or alternately be manually turned within limits, g) said base further having a pair of upwardly facing cut-outs in said bearing surface, h) said platform member having two oppositely disposed radially extending bridges, extending outward through said cut-outs in the base, i) a pair of manually-engageable semi-circular actuator grip members on said bridges, respectively, and disposed at the exterior of said base so as to be accessible to the fingers of the user, and j) multiple cooperable camming devices on the platform member and lid assembly, responsive to turning of the grip members, to raise the platform member sealing surface against the window sealing surface and thereby improve the seal therebetween.

13. The invention as set forth in claim 12, wherein:

a) said grip members are movable between opposite angular positions on said base, and further including: cooperable detent structures at the exterior of the base and on the inner surface of one grip member, for yieldably retaining the latter when the lid assembly is open, to avoid interference between the camming devices when the lid assembly is being moved toward its closed position.

14. A cosmetic compact, comprising in combination:

a) a base, b) a lid assembly and a hinge pivotally connecting it to said base, said lid assembly comprising a cover having an expansive central opening, c) said lid assembly further comprising a window fitted in said expansive central opening and sealingly engaged therewith, d) said window having a downwardly facing, circular sealing surface, and further having a plurality of depending radially inwardly facing latching lugs circumferentially spaced about the periphery of the window, e) a substantially cylindrical platform member disposed between said base and said lid assembly, said platform member being captive therein and further being movable within limits in both a vertical and a horizontal direction with respect to said base and lid assembly, and being turnable therein, f) said platform member further having an upwardly facing circular sealing surface adapted to seal against the sealing surface of the window, g) said base having an upwardly facing, semi-circular bearing surface against which said platform can rest or alternately be manually turned within limits, h) said base further having a pair of upwardly facing cut-outs in said bearing surface, i) said platform member having two oppositely disposed radially extending bridges, extending outward through said cut-outs in the base, respectively, j) a pair of manually-engageable substantially semi-circular actuator grip members on said bridges, respectively, and disposed at the exterior of said base so as to be accessible to the fingers of the user, and k) a series of circumferentially disposed cam ramps on the exterior of said platform member, said cam ramps having clearance spaces between them to receive the respective latching lugs of the window, whereby upon turning of the actuator grip members when the lid assembly is closed, the window latching lugs ride along the cam ramps to exert a force on the platform member in a direction tending to tighten engagement between said circular sealing surfaces on the window of the lid assembly and on the platform member, and thus reinforce a seal therebetween.

15. The invention as set forth in claim 14, wherein:

a) said base comprises a body, and said body has two pairs of exterior arcuately extending recesses, b) said grip members are of elongate, arcuate configuration and are received respectively, in said pairs of recesses.

16. The invention as set forth in claim 14, wherein:

a) the grip members and their respective bridges are all molded integral with one another and with substantially all of the remainder of the platform member.

17. The invention as set forth in claim 14, wherein:

a) said base is characterized by exterior surfaces having the configuration of the lateral surfaces of a geometric prism.

18. The invention as set forth in claim 14, wherein:

a) said base is characterized by exterior surfaces having the configuration of the lateral surfaces of an oval prism.

19. The invention as set forth in claim 14, wherein:

a) said base is characterized by exterior surfaces having the configuration of the lateral surfaces of a rectangular prism with opposed bulging portions.

20. The invention as set forth in claim 14, wherein the window is constituted of a substance selected from the group consisting of co-polyester, polyester, and cellulose nitrate.

* * * * *